US005149314A

United States Patent [19]

Ciolino et al.

[11] Patent Number: 5,149,314

[45] Date of Patent: * Sep. 22, 1992

[54] ENHANCED EXERCISE FLOAT

[75] Inventors: Peter N. Ciolino, Elmwood Park, N.J.; Peter A. Ciolino, 561 Cherry Tree La., Kinnelon, N.J. 07405

[73] Assignee: Peter A. Ciolino, Kinnelon, N.J.

[ * ] Notice: The portion of the term of this patent subsequent to Feb. 25, 2009 has been disclaimed.

[21] Appl. No.: 530,620

[22] Filed: May 30, 1990

Related U.S. Application Data

[63] Continuation-in-part of Ser. No. 359,215, May 31, 1989, abandoned.

[51] Int. Cl.[5] ..... A63B 21/008

[52] U.S. Cl. ..... 482/111; 482/142; 472/129; 5/481; 441/129; D21/237

[58] Field of Search ..... 272/71, 72, 93-96, 272/116, 126-128, 131, 135, 137-139, 144, 142, 143, 1 B; 441/88, 106, 108, 113, 125, 127-129; 5/417, 419, 420, 431, 470, 481; 434/254; D21/237, 238

[56] References Cited

U.S. PATENT DOCUMENTS

| | | | |
|---|---|---|---|
| D. 272,935 | 3/1984 | Corey et al. | D21/237 X |
| 2,132,544 | 10/1938 | Shaw | 441/127 |
| 2,623,574 | 12/1952 | Damsch | 441/129 X |
| 3,860,976 | 1/1975 | Suyama | D21/237 X |
| 4,198,044 | 4/1980 | Holappa | 482/142 X |
| 4,394,783 | 7/1983 | Simmons | 5/481 X |
| 4,858,913 | 8/1989 | Stuart | 272/71 |

FOREIGN PATENT DOCUMENTS

| | | | |
|---|---|---|---|
| 358494 | 2/1906 | France | 272/142 |

OTHER PUBLICATIONS

"Marine Life Saving and Water Short Equipment" by Atlantic-Pacific Mfg. Corp., Catalog No. 56, Feb. 1957.

*Primary Examiner*—Richard J. Apley
*Assistant Examiner*—Joe H. Cheng
*Attorney, Agent, or Firm*—Hopgood, Calimafde, Kalil, Blaustein & Judlowe

[57] ABSTRACT

An exercise float platform is formed of specifically dimensioned buoyant sections connected by flexing hinges to permit a user to perform an exercise routine in an aquatic environment. The buoyancy of the individual sections can be selectively adjusted depending on the weight distribution of the individual, or the exercise routine intensity. The exercise float permits the user to perform exercise routines in the water focused on the back, hips and stomach muscle groups along with allowing flexible upper and lower body workouts while either sitting below the water level or reclined above the water level. Separate elastic straps are applied to increase the level of resistance during exercise.

13 Claims, 6 Drawing Sheets

KNEE EXTENSION

BICEP CURLS

ENHANCED EXERCISE FLOAT

STATEMENT OF RELATED CASE

This is a continuation-in-part of application Ser. No. 07/359,215 filed on May 31, 1989, now abandoned.

The present invention generally relates to an apparatus for enhanced aquatic exercising. More particularly, the present invention relates to a flotation device capable of specifically delineated movements in an aquatic environment suitable for a series of exercise routines directed to the back and stomach muscle groups.

BACKGROUND OF THE INVENTION

During the past decade, there has been an explosion of interest in physical activity as both a pastime and a means of acquiring and maintaining good health. Much of the current interest in exercise and other similar activities is based on the recent findings that correlate longevity with active lifestyles. Pursuant to this increased awareness, a corresponding increase in the variety of exercise activities has spawned a plethora of new businesses focused on servicing the needs of this new market.

Many exercise routines are directly focused on the stomach, hips and back as a means for reducing weight and developing a more attractive figure. Almost all structured aerobic exercise routines have a significant portion of their workout concentrated on the stomach, hips and back. These anatomical areas are the first to collect fat in appreciable quantities and therefore engender the most concern from those in pursuit of a slimmer figure.

Conventional forms of exercising the stomach, hip and back muscles include such classic routines as the "sit-up", "leg raises", and "back arches". These routines are often performed over many cycles on a hard surface such a floor, or at best, a pad placed on a floor. These routines cause major stress on back muscles and the vertebrae of the spine, and irritation of the tail bone. Persons suffering from various levels of back problems or similar ailments simply cannot perform more than a handful of sit-ups without increasing levels of pain and discomfort. For the most part, persons with limited capability to do sit-ups are relegated to much less effective forms of exercise.

It has been discovered over the years that water borne exercise involves significantly less stress during a workout while providing the same level or even a greater level of exercise. Aquatic exercising has become a dominate form of physical therapy for persons suffering from bad backs, knee disorders and for the elderly. In fact, aquatic exercises are performed in a variety of environments including pools, spas and the beach. It has been found that the beach with its attendant surf offers distinct forms of exercising, including wave riding and similar endeavors more characteristic of fun than a traditional workout.

While the field of aquatic exercise has boomed, it has remained concentrated on only a few forms of exercise and thus limited to certain muscle groups. In particular, aquatic exercise is presently dominated by exercise routines such as swimming, jogging, jumping, and certain arm and leg movements. For the most part, there have been few, if any specific routines directed to the stomach, hips, and back. This void is mostly reflective of the fact that these muscle groups cannot be readily exercised in an aquatic environment.

As reflected in co-pending U.S. patent application Ser. No. 359,215, a specifically delineated exercise float device has been developed related to aquatic exercise routines focusing on development and conditioning of stomach and back muscles. The teachings of the above-noted patent application are hereby incorporated by reference as if fully restated. The exercise float described in said patent application is a simplified structure that permits flexure of isolated muscle groups, restrained by the flow resistance associated with the aquatic environment and gravity subdued to some extent by the natural buoyancy of the water. This permits a workout consistent with the needs of a large percentage of users, including the elderly and those undergoing physical therapy. It has been recently discovered that some users desire a more vigorous workout. In view of the special needs of these users, the original exercise float has been adapted and improved in a manner more fully disclosed and taught below.

SUMMARY AND OBJECTS OF THE INVENTION

An object of the present invention is to provide a device to enhance aquatic exercise routines performed in a swimming pool or similar environment.

Another object of the present invention is to provide an aquatic exercising device comprised of a multi-part flotation platform having specifically located hinges that act to permit the controlled flexing of the platform pursuant to the specific requirements of the exercise routine being performed.

Yet another object of the present invention is to provide a multi-sectioned flotation platform with sufficient buoyancy to support and hold a user thereof essentially at about the surface of the water while permitting the user to perform exercise routines focused on the stomach, hip and back.

A further object of the present invention is to provide a collapsible multi-sectioned flotation device comprising at least two sections connected by a hinge wherein said hinge permits the user thereof to engage in sit-ups, leg lifts, and back arches while floating in a pool or similar aquatic environment.

Another object of the present invention is to provide a multi-sectioned flotation device where the buoyancy of each float can be changed according to the weight distribution of the user and the type and intensity of the exercise routine desired.

It is still another object of the present invention to provide a multi-section flotation device which further includes specifically located attachment points for connection to elongated elastic straps having specific resistive characteristics.

It is yet another object of the present invention to provide elongated elastic straps with handgrips and/or foot stirrups for direct attachment to an exercise flotation device wherein the straps provide additional resistance in conjunction with the exercise float in the performance of specific exercise routines.

The above and other objects of the present invention are realized in a specific illustrative multi-sectioned flotation device wherein at least two sections are connected by a hinge thus permitting the relational pivoting motion of the sections pursuant to specific user flexing movement during an exercise routine performed in an aquatic environment.

Attachment points for connecting the elastic strap to the exercise float are found on each float section. The elastic strap apparatus comprises an attachment means located at each end of the elongated elastic strap, a handgrip and a foot stirrup. The use of the handgrip or foot stirrup will depend on both the attachment points of the strap on the exercise float and on the specific exercise routine pursued.

The foregoing features of the present invention may be more fully appreciated from the following detailed discussion of a specific illustrative embodiment thereof, presented hereinbelow in conjunction with the accompanying drawings, in which:

FIG. 1 provides a top view of the multi-sectioned flotation platform of the present invention;

FIG. 2 provides a side view of the multi-sectioned flotation platform of the present invention;

FIG. 3 provides a top view of the elastic strap apparatus;

FIGS. 4*a* and *b* illustrates an inclined exercise on the flotation platform;

FIGS. 5*a* and *b* illustrates a leg exercise performed on the flotation platform from a seated position;

FIGS. 6*a* and *b* illustrates an arm exercise performed on the flotation platform from a seated position;

FIGS. 7*a* and *b* illustrates the use of the flotation platform and elastic straps in performing "knee to chest" exercises;

FIGS. 8*a* and *b* illustrates the use of the flotation platform and elastic straps in performing "bicep curls"; and FIGS. 9*a* and *b* illustrates the use of the flotation platform and elastic straps in performing a "rowing" exercise.

DETAILED DESCRIPTION OF THE INVENTION

Discussing the present invention first in overview, it is a fundamental objective to provide a exercise platform that combines the properties of significant buoyancy with the resistance associated with precisely located elastic straps t address specific aquatic exercises focused on or directed to the stomach, hips, arms, legs and back.

Figure 1:
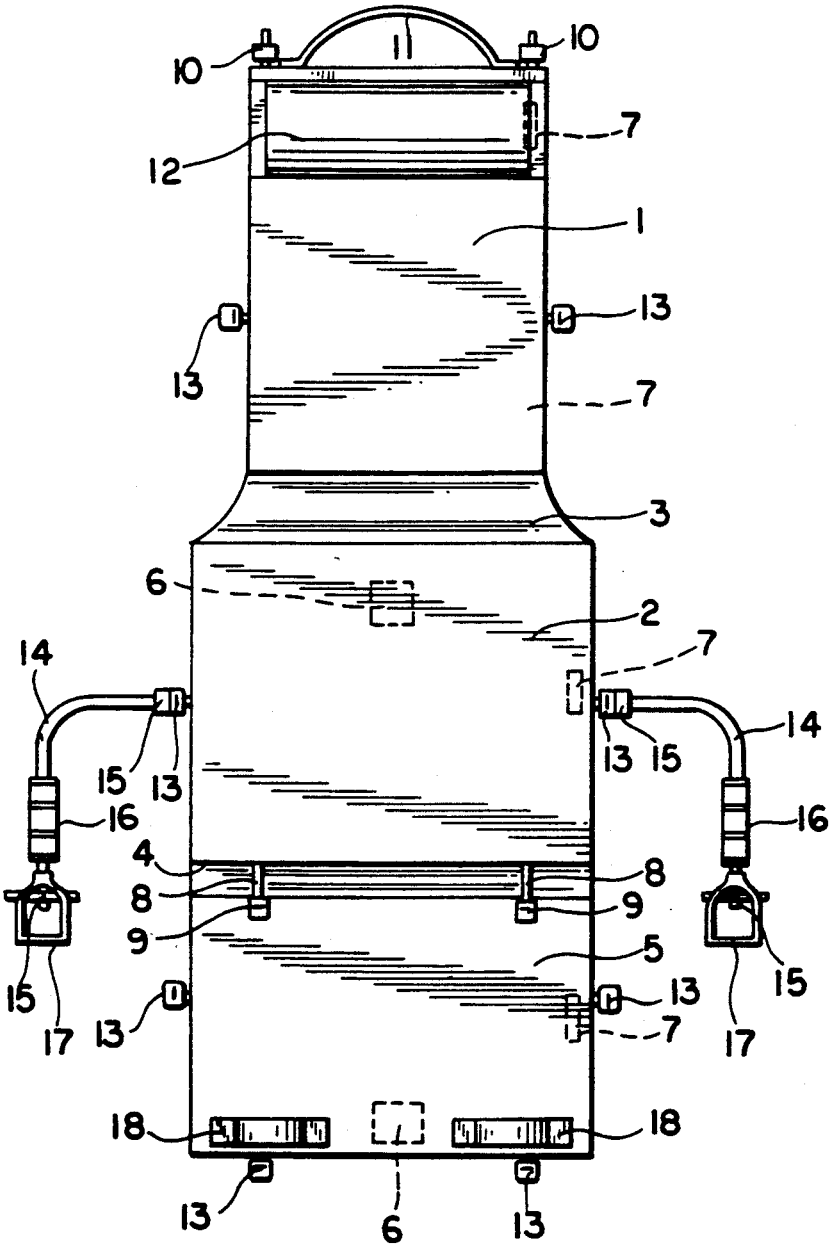
Figure 2:
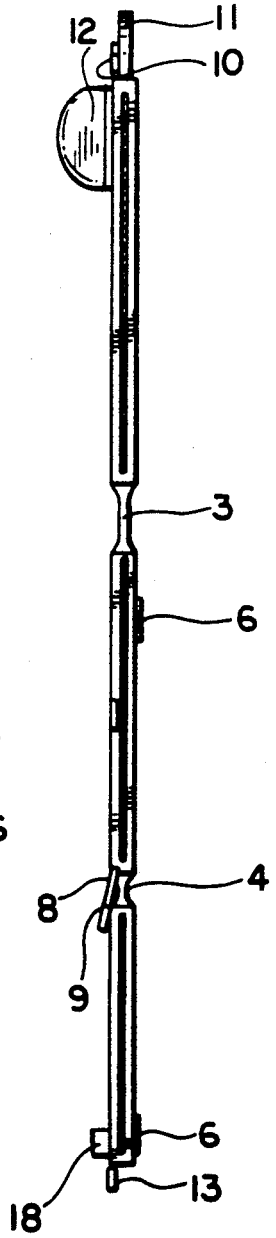

Bearing this in mind and referring to FIGS. 1 and 2, the structure of the flotation platform is presented in top and associated side view. In this particular embodiment, the flotation platform is formed of three discrete float sections. Applying like numerals for the same element shown in the various views, an upper float section 1 is connected to a mid-float section 2, by vinyl hinge 3. This vinyl hinge 3 separates the upper and lower float section by a distance of approximately 5–6 inches. The use of vinyl for hinge 3 is merely illustrative of suitable hinge material although the use of water resistant material such as vinyl is preferred in view of the aquatic environment for use. The 5–6 inches of spacing between the upper and lower float sections permits the easy flexing of the platform at the hinge location with limited pinching of the user during this flexing. Hinge 3 permits pivoting of the separate sections up to 90°.

The upper float section 1 is dimensioned to correspond to the shape of the back of the individual user and to provide support to the user during the envisioned exercise routines. In this regard, the general shape of the upper float section is long and narrow so that in use it will extend from the user's head or neck to the lower back area. The width of the upper float section 1 at the shoulders should be sufficiently narrow so as to not interfere with the free movement of the arms during use. The lower float section 2, is somewhat wider than the upper float section 1 due to the need to support the buttocks and thighs of the user, otherwise referred to herein as the user's seat. The vinyl hinge 3 supports the lower back. Hinge 3 allows the upper and lower float sections to move in similar or different directions depending upon the type of exercise routine performed.

The upper, lower, and foot float sections are all formed of compartmentalized hollow vinyl containers which are capable of receiving buoyant producing materials such as DURAFOAM® closed cell flotation cushions. These compartments or pockets are arranged to permit the controlled distribution of the buoyant material to maximize comfort, balance and degree of buoyancy. Access to the compartments is via VELCRO enclosure 7, as shown on each of the separate float sections. As can be seen, the selection of the amount, shape and type of buoyant cushions to pack the various float sections provides the user tremendous flexibility in customizing the exerciser float to the user's particular needs in terms of support and stiffness. The outer shell of the float sections is formed of TEXTRA®, PVC or other suitably water resistant material. The float shell is normally stitched; alternatively, the seams can be fixed by per se well known heat sealing techniques. This process offers significant economics of scale in production. In addition, the aforesaid compartments can be made of an air tight material and filled with air to create the requisite buoyancy. For certain uses, the float sections can be made of solid buoyant material.

Continuing with FIG. 1, a second hinge 4 of approximately 2 inches and foot float 5 is attached to the lower float 2. The foot float 5 is attached to the underside of the lower float 2, via velcro 6, for mounting the device in the water. This permits exercise of the legs and knees while either in a reclined position above the water level or in a seated or flexed position substantially below the water level. As an alternative form of buoyancy, the upper, lower and foot float can be formed directly of a solid buoyant material.

Mounting straps 8 are located on the lower float for ease of handling and mounting during use in the water along with providing male buckles 9 which connect to female buckles 10 on the upper float so that the entire device can be folded neatly into a package for ease of handling and portability. The mounting straps 8 permit the user to pull the flotation platform into position beneath him while standing in the water.

A shoulder strap 11 is provided for portability. A headrest 12, buoyed by air, closed cell foam, or other material is provided at the top of the upper float 1 for comfort, and to keep the head and ears out of the water during exercise. The material of construction are all soft flexible water resistant materials. If stiffeners are needed for particular routines, these can be appropriately placed into the compartments.

Figure 3:
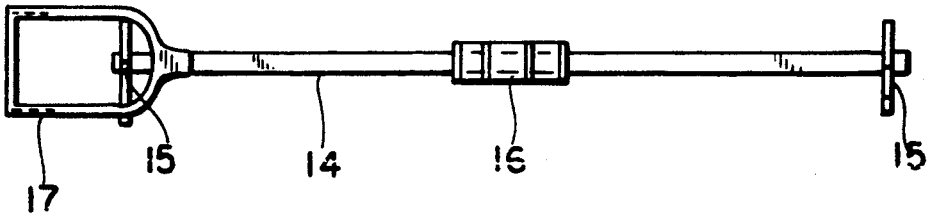

The elastic strap apparatus, for use in conjunction with the exercise float, is separately depicted in FIG. 3. The elastic strap apparatus is formed of an elastic strap 14 having separate attachment clasps 15 at opposing ends. A cushioned handgrip 16 is located between the two terminal clasps on strap 14, and a stirrup 17 is provided at one end of strap 14.

The elastic strap apparatus is formed of water compatible materials, preferably synthetic rubber based elastomers. Elastic strap 14 is approximately 0.75 inches in diameter and 30 inches in length. The location of handgrip 16 is adjustable along the length of strap 14; once the desired location of handgrip 14 is achieved, it is fixed by squeezing the handgrip directly; alternate fixing means can also be substituted. The handgrip 16 is preferably formed of a cushioned or foamed material for comfort and ease of use.

Figure 4B:
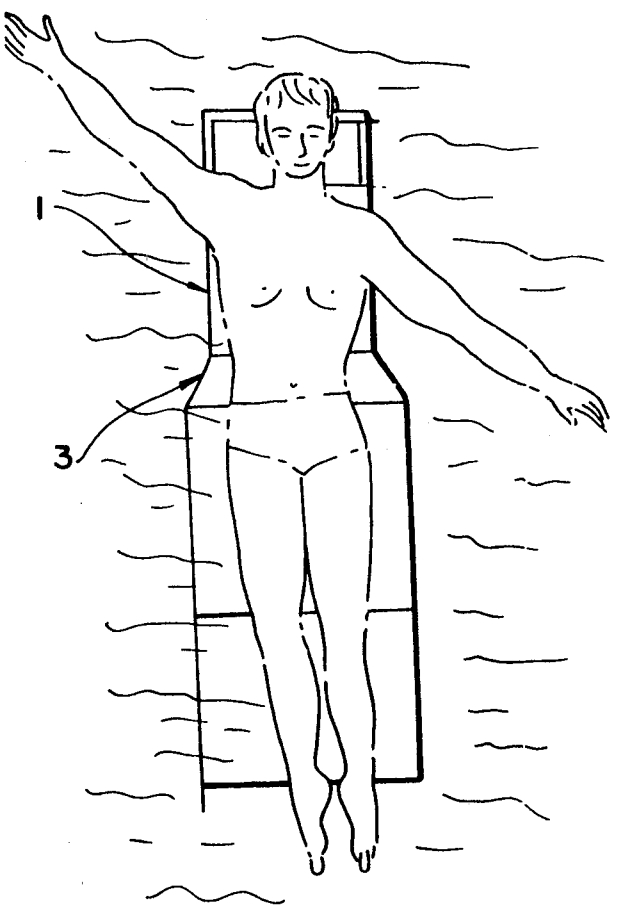
Figure 4A:
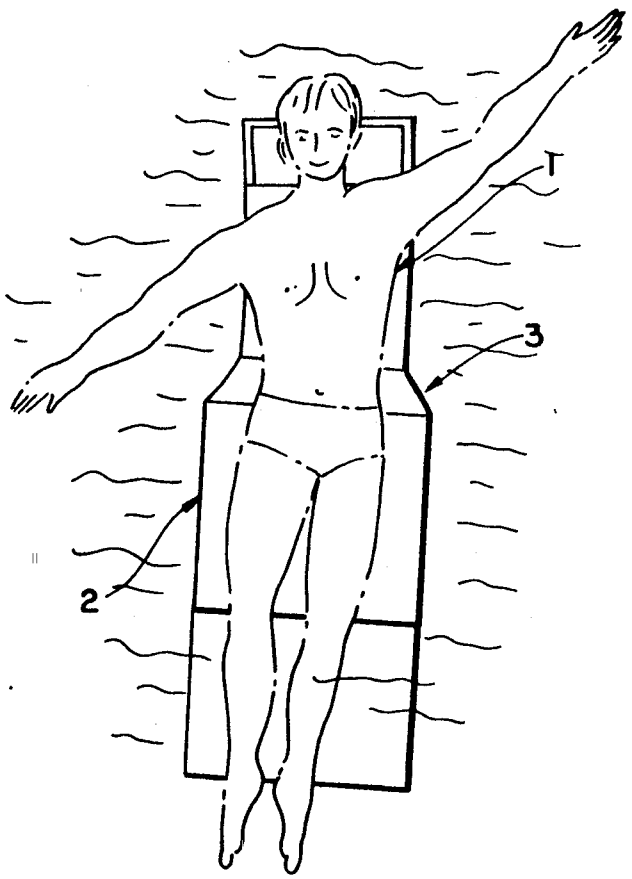
Figure 5A:
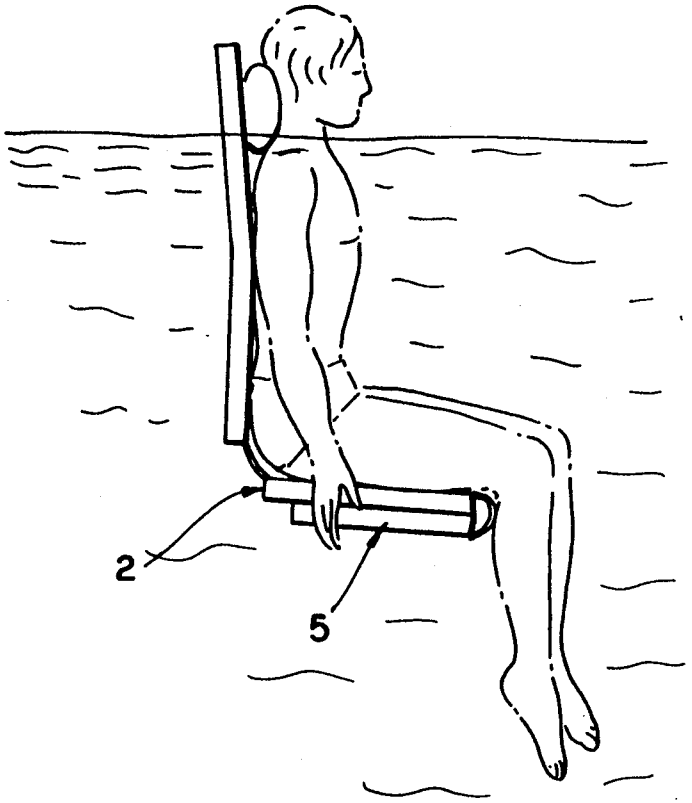
Figure 5B:
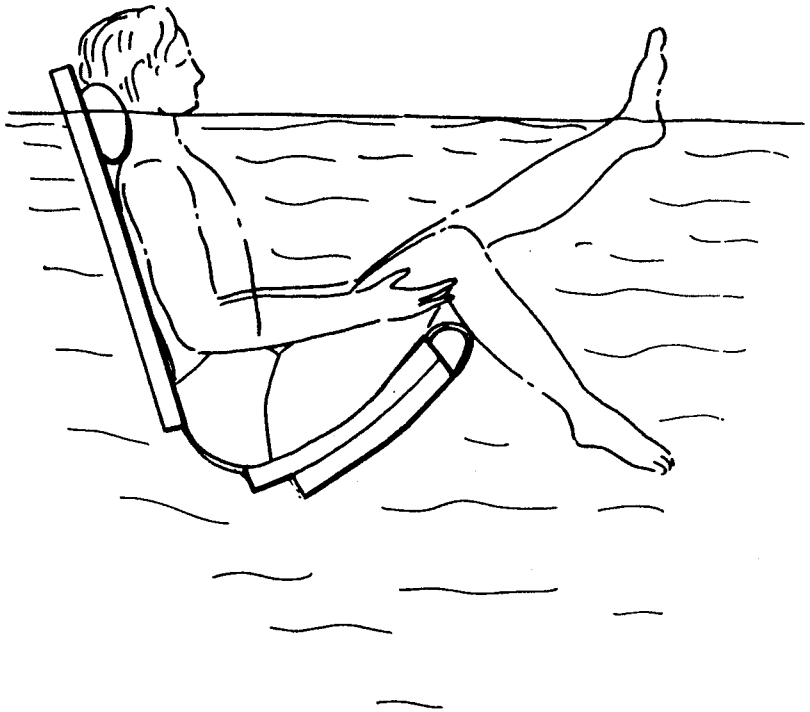
Figure 6B:
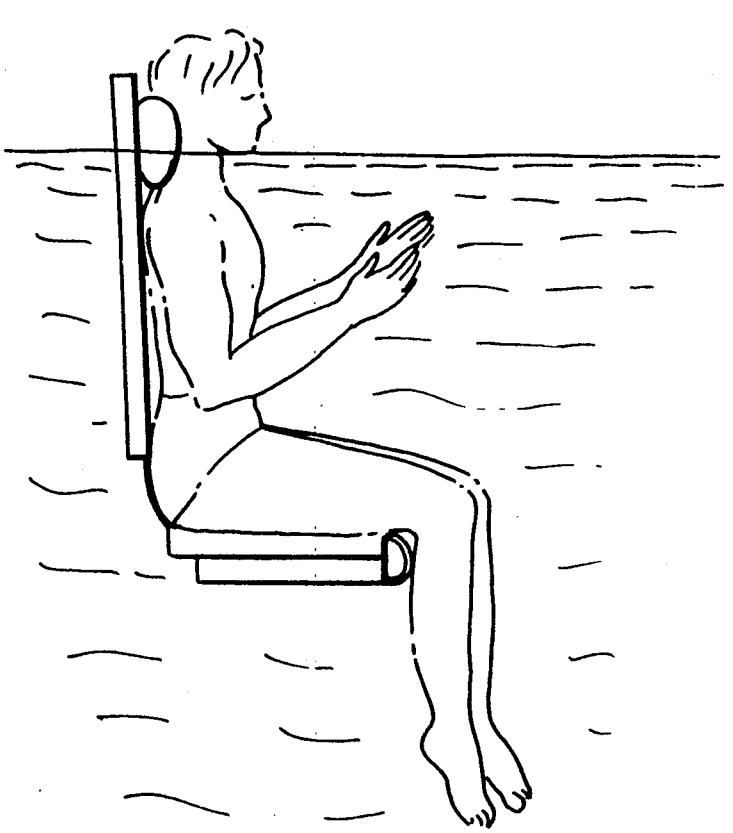
Figure 6A:
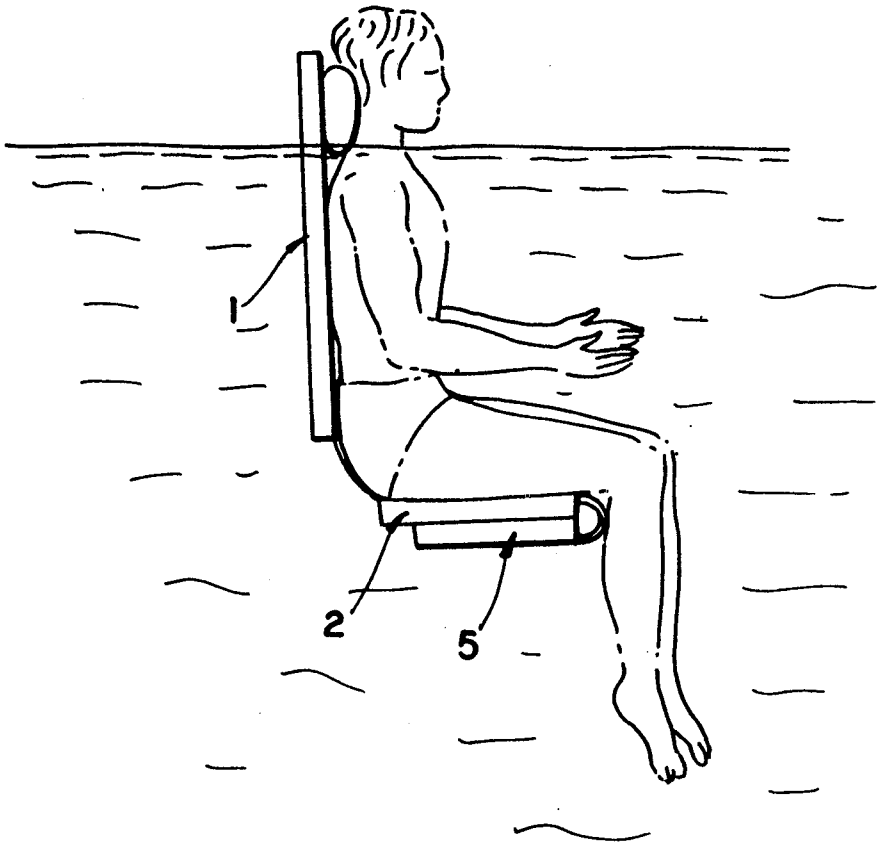

Referring now to FIGS. 4, 5 and 6, use of the flotation platform in a series of specific exercises is illustrated. In FIG. 4, for example, the flotation platform is implemented in an inclined aquatic exercise, wherein lateral side to side movements are made by the user. The flotation platform, comprising upper (1) and lower (2) floats support the user near the surface of the water, while flexure of the hinge (3) corresponds to the user's waist.

In FIG. 5, a knee extension exercise is illustrated, indicative of the flotation platform's application from a seated position. In this form, the foot float (5) is folded underneath the lower float (2). Similarly, FIG. 6 illustrates arm exercises performed in the seated position on the flotation platform. Control of the relative buoyancy of the lower and upper floats, permits regulation of the degree of difficulty for certain exercises, and the position of the user vis-a-vis the water level. As can be seen, the above flotation platform can be applied in many aquatic environments including pools, such as a local YMCA, spas and the beach. The flotation platform is especially adapted to wave riding for all generations since it permits the user to float in the surf in a seated, supine or prone position.

The elastic strap apparatus is used in conjunction with the multifloat exercise platform to increase the resistance in certain aquatic exercise routines. In this regard, the multifloat platform is provided with peripheral connection slots 13 corresponding and suitably mated to the attachment clasps 15 located at each end of the elastic strap apparatus. In this way, the elastic strap can be connected to individual float sections, thus providing a controlled increase in movement resistance. Symmetry is maintained by applying a second strap at a corresponding but opposing location for attachment. As can be recognized, both ends of the elastic straps can be attached to various float locations creating differing forms of aquatic exercise.

The stirrup is provided for anchoring to the user's foot, again in conjunction to strap attachment to the float platform. Anchoring the straps to the foot creates additional and differing levels of resistance, thus providing greater flexibility in training. Two foot straps 18 made with a similar vinyl, PVC or other material are located on the foot float 5 to provide more stability during exercise with the elastic strap 14.

Figure 8A:
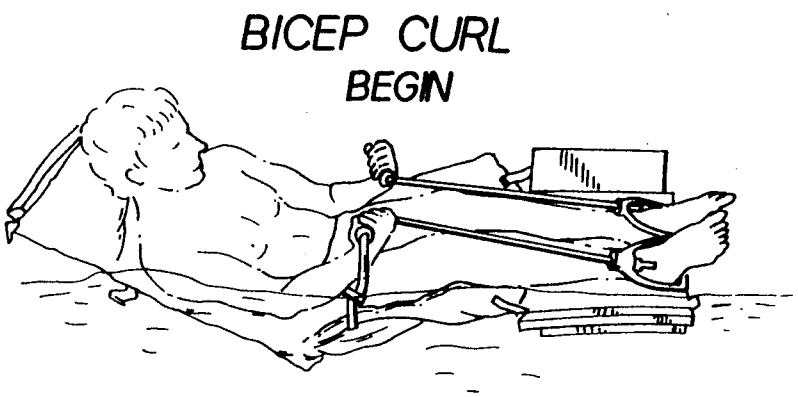
Figure 7A:
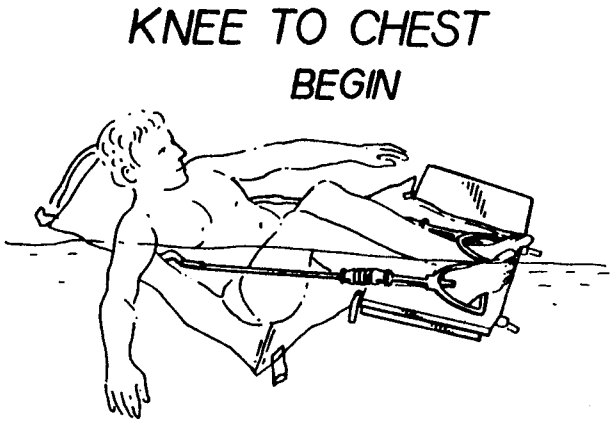
Figure 7B:
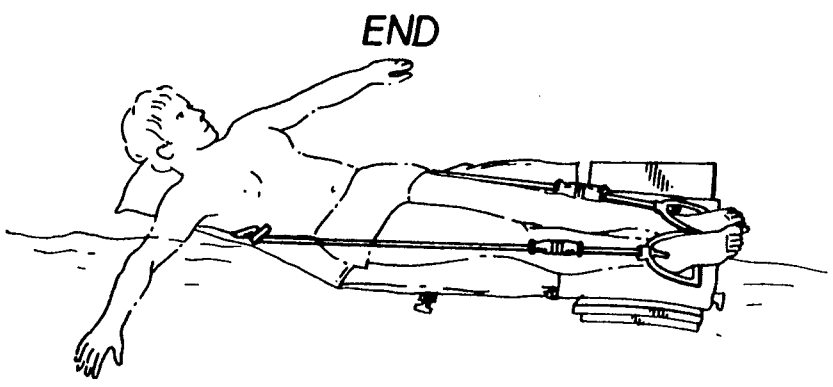

Application of the elastic straps in conjunction with flotation platform is graphically illustrated in FIGS. 7–9. In FIG. 7, the elastic strap attachment 15 is connected to upper float 1 via matching clip 13, on each side. The user places his feet in stirrup 17 while positioning himself conventionally on the platform. This knee to chest routine involves extension from the position in FIG. *7a* to the fully inclined position depicted in FIG. *7b*. The flotation platform supports the user near the water surface during this routine.

Figure 8B:
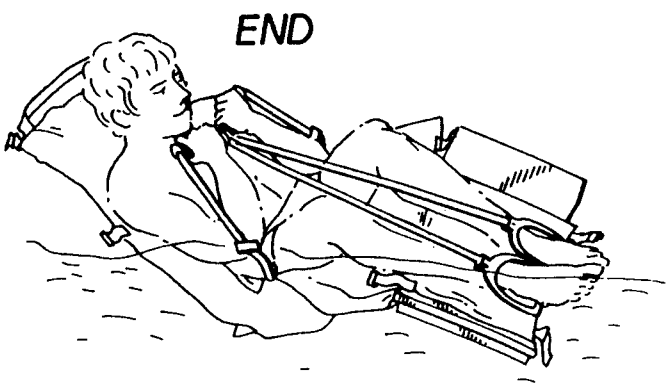

Now referring to FIGS. 8(*a* and *b*), the elastic strap position has been moved to the lower float for attachment, while the user's feet remain in the stirrups. For the "bicep curl", the user grasps handgrips 16 and iteratively draws his hands to his upper chest area (see FIG. 8*b*).

Figure 9A:
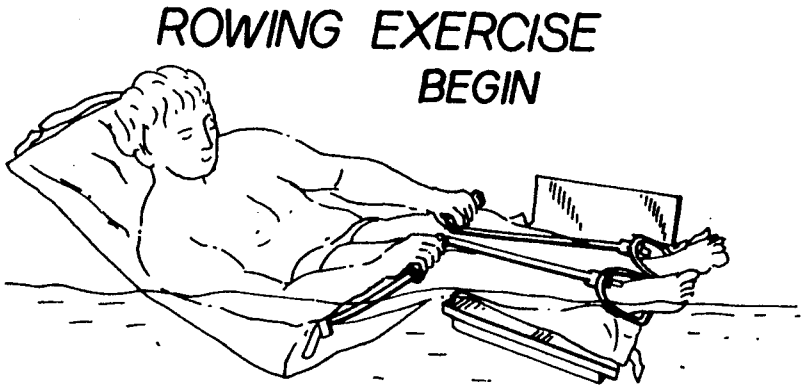
Figure 9B:
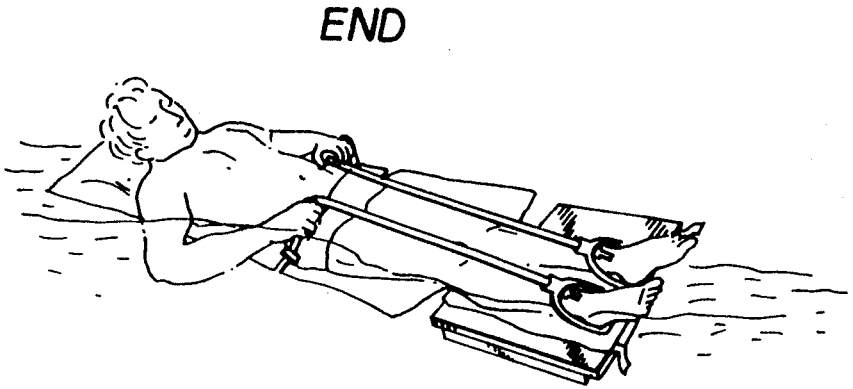

To perform a rowing exercise, as shown in FIG. 9, the elastic straps are similarly attached to the lower float (2); the iterative movement is focused on the extension and flexing of the back and waist between the two positions shown in FIGS. 9*a* and 9*b*. The elastic straps provide stability and increased resistance, while permitting the completion of the exercise routine in a comfortable environment.

The above-described arrangement is merely illustrative of the principles of the present invention. Numerous modifications and adaptations thereof will be readily apparent to those skilled in this art without departing from the spirit and scope of the present invention.

I claim:

1. An apparatus to provide support and buoyancy to a user during an exercise routine performed in an aquatic environment comprising:

a first flotation section configured to correspond to the shape of the user's back as extending from the upper shoulders to the waist of said user, having a width that is sufficiently narrow thereby permitting the free movement of the arms and shoulders, and having sufficient buoyancy to support the user's back at a submerged surface position in the aquatic environment to perform the exercise routine, a second flotation section having a greater width than said first flotation section and configured to correspond to the shape of the user's seat as made up of the buttocks to the upper thigh region of said user and having sufficient buoyancy to support said seat at said submerged surface position in said aquatic environment, a first hinge means located between and operatively connecting said first flotation section with said second flotation section in a manner permitting pivoting of said sections through an angle of at least 90° between said first and second flotation sections, a third flotation section configured to correspond to the user's legs and feet, having sufficient buoyancy to support said user's lower legs and feet at said submerged surface position in said aquatic environment, a second hinge means located between and operatively connecting said third flotation section to said second flotation section in a position so that said first, second and third flotation sections form a substantially elongated float conforming to the total length of the user, a plurality of mating attachment points located on the perimeter of at least one of said first, second and third flotation sections, and a pair of elastic strap means, each one of said elastic strap means having attachment means located at one end of said elastic strap means for attaching to one of said plurality of mating attachment points and handgrip means located on said elastic strap means distal from said attachment means, wherein said elastic strap means for providing increased resistance to water borne movement by said person during said exercise routine.

2. The apparatus of claim 1 wherein said flotation sections are formed of a water resistant material and have at least one inner pocket in each flotation section for holding buoyant producing means.

3. The apparatus of claim 2 wherein said buoyant producing means comprises an air filled closed cell foam cushion.

4. The apparatus of claim 2 wherein said inner pocket is airtight and capable of inflation with a buoyant producing gas.

5. The apparatus of claim 1, wherein the buoyancy of said flotation sections can be adjusted in accordance with a user selected degree of intensity for said exercise routine.

6. The apparatus of claim 1, wherein said second hinge means is removably attached to said second flotation section.

7. The apparatus of claim 1 wherein said apparatus is collapsible to a form that is easily transported by said user, and further comprises handle means positioned to enhance said transport.

8. The apparatus of claim 1 further comprising a pair of stirrup means, each one of said stirrup means configured to grip a user's foot is attached to said elastic strap means at the other end of said elastic strap means opposite to said attachment means.

9. A method of aquatic exercise performed by a user concentrated on developing and conditioning the muscle groups associated with a user's stomach, back and hip area comprising the steps of:

placing into an aquatic environment a flotation platform of the type characterized by a first float section and a second float section joined together by a first hinge means, and said second float section and an attachable attachment means for attaching a third float section including a second hinge means, and a pair of elastic strap means, each of said elastic strap means having attachment means for connecting to one of a plurality mating attachment points located on the sides of said flotation platform, a stirrup means located on said elastic strap means opposite of said attachment means, wherein said first float section is shaped to correspond to the shape of said user's back without interfering with the free movement of said user's arms and shoulders, said second float section is shaped to correspond to a user's seat, and said hinge permits pivoting of at least 90°; and mounting onto said flotation platform whereby said user is supported at a submerged surface position in the aquatic environment facing upward and said user's back is located proximate to said first hinge means permitting movement from both an inclined and upright user position in said aquatic environment during the performance of an aquatic exercise by using said stirrup means for performing an knee to chest exercise.

10. The method of claim 9, wherein said first, second and third float sections of said flotation platform can be individually adjusted in terms of buoyancy thereby providing the ability to change type and degree of difficulty of exercise.

11. The method of claim 10, wherein said flotation platform has mounting straps on said second float section to ease the positioning of said user prior to said aquatic exercise.

12. The method of claim 9, wherein said flotation platform comprises buoyant producing means, said buoyant producing means is an air filled closed cell foam cushion.

13. The method of claim 9; wherein said flotation platform further including a handgrip means located on said elastic strap means distal from said attachment means, and said method further including the step of positioning said attachment means to said second float section and said user's feet on said stirrup means and the user's hand on said handgrip means for performing a biceps curl exercise and a rowing exercise.

* * * * *